United States Patent [19]

Martin

[11] Patent Number: 4,881,557

[45] Date of Patent: Nov. 21, 1989

[54] SMOKING ARTICLE WRAPPER AND METHOD OF MAKING SAME

[75] Inventor: Richard H. Martin, Brevard, N.C.

[73] Assignee: P. H. Glatfelter Company, Spring Grove, Pa.

[21] Appl. No.: 183,979

[22] Filed: Apr. 20, 1988

[51] Int. Cl.[4] ..... A24D 1/02

[52] U.S. Cl. ..... 131/365

[58] Field of Search ..... 131/331, 365; 162/139

[56] References Cited

U.S. PATENT DOCUMENTS

| | | | |
|---|---|---|---|
| 4,231,377 | 11/1980 | Cline et al. | 131/9 |
| 4,420,002 | 12/1983 | Cline | 131/334 |
| 4,433,697 | 2/1984 | Cline et al. | 131/365 |
| 4,450,847 | 5/1984 | Owens | 131/365 |

*Primary Examiner*—V. Millin

*Attorney, Agent, or Firm*—Kerkam, Stowell, Kondracki & Clarke

[57] ABSTRACT

A cigarette paper which when fabricated into a cigarette with a suitable tobacco column produces up to 80% less particulate sidestream smoke than do cigarettes fabricated with conventional cigarette paper wrappers. This reduction of sidestream smoke is accomplished by incorporation of a mixture of freshly precipitated and particulate magnesium hydroxides in the cigarette paper sheet as paper fillers. The high percentage reductions in sidestream particulate smoke are obtained when the median particle size of the particulate magnesium hydroxide filler is relatively large, e.g., 15 micrometers.

36 Claims, No Drawings

SMOKING ARTICLE WRAPPER AND METHOD OF MAKING SAME

This invention relates to a smoking article wrapper which when provided with a suitable tobacco column produces up to 80% less particulate sidestream smoke than do cigarettes fabricated with conventional cigarette paper wrappers and to methods of producing same.

BACKGROUND OF THE INVENTION

It has been the endeavor of the industry to reduce visible sidestream smoke which most non-smokers consider to be irritating and offensive. Some of the patents dealing with sidestream smoke are as follows.

U.S. Pat. No. 4,231,377, to W. K. Cline and R. H. Martin is directed to a cellulosic wrapper for a tobacco charge which contains at least 15% magnesium oxide and at least 0.5% of a chemical adjuvant selected from alkali metal acetates, carbonates, citrates, nitrates, and tartrates. Both a smoking product and the method of smoking product preparation are disclosed. Furthermore, the patent discloses that magnesium oxide, as referred to in the patent, includes its hydrate, magnesium hydroxide, and mixtures of magnesium oxide and magnesium hydroxide.

U.S. Pat. No. 4,420,002, to W. K. Cline is directed to a cellulosic wrapper for a tobacco charge which contains 5% to 50% magnesium hydroxide filler having a median particle size less than 10 micrometers and an unreactive magnesium oxide filler. In addition, this patent discloses that best results are achieved by adding the magnesium hydroxide filler to the fiber pulp furnish to achieve an intimate contact between filler and fibers. Both a smoking product and the method of smoking product preparation are described.

U.S. Pat. No. 4,433,697, to W. K. Cline and W. F. Owens is directed to a cellulosic wrapper for a smoking article which contains 1% to 5% of a ceramic fiber plus magnesium hydroxide and/or magnesium oxide fillers. The ceramic fibers were selected from a group consisting of polycrystalline alumina, aluminum silicate, and amorphous alumina. Furthermore, this patent discloses that the addition of ceramic fiber provides a more solid ash and even greater sidestream smoke reduction than the prior art. Again, both a smoking product and the method of smoking product preparation are disclosed.

U.S. Pat. No. 4,450,847 to W. F. Owens is directed to a cellulosic wrapper containing amorphous magnesium hydroxide gel freshly precipitated on the fibers of the sheet as a filler, plus unreactive magnesium oxide, calcium carbonate or both as co-filler(s). Furthermore, this patent specifically discloses a wrapper with 2% to 8% by weight of potassium acetate as a chemical adjuvant. A key disclosure in the patent pertains to the physical characteristics of an "amorphous gel of magnesium hydroxide" and the manner in which deposition of said gel on the fiber or paper provides more intimate contact and complete coverage of the paper fibers during in situ precipitation. In addition to the wrapper, itself, both a smoking product and the method of smoking product preparation are disclosed.

BRIEF DESCRIPTION OF THE INVENTION

The purpose of this invention is to provide a cigarette paper which when fabricated into a cigarette with a suitable tobacco column produces up to 80% less particulate sidestream smoke than do cigarettes fabricated with conventional cigarette paper wrappers. More specifically, this extraordinary reduction of sidestream smoke is accomplished by incorporating a mixture of freshly precipitated and particulate magnesium hydroxide in the cigarette paper sheet as paper fillers. Furthermore, unexpectedly high percentage reductions in sidestream particulate smoke are obtained when the median particle size of the particulate magnesium hydroxide filler is relatively large, e.g., 15 micrometers. A cigarette which exhibits a 70% or greater reduction in sidestream particulate smoke is perceived as producing little, if any, visible sidestream smoke during static burning. Most non-smokers consider sidestream smoke to be irritating and offensive, thus a smoking product with only 25% of the particulate sidestream smoke of conventional cigarettes is expected to be more socially acceptable to the general public.

DETAILED DESCRIPTION OF THE INVENTION

In the specification and claims the words "freshly precipitated magnesium hydroxide" means using the precipitate before any appreciable agglomeration takes place. The freshly precipitated magnesium hydroxide is made by the addition of caustic, and that is either sodium hydroxide or potassium hydroxide to a solution of a magnesium salt and in the specific case I use magnesium acetate although other salts can be used.

Based on the patents described above, there has been developed a first generation low sidestream cigarette paper product, which may have a basis weight of 45 $g/M^2$, contains 12% to 15% precipitated magnesium hydroxide as filler, 28% to 25% calcium carbonate co-filler, and approximately 4% by weight of potassium and sodium acetate burning chemicals. Such a sheet is prepared with the magnesium hydroxide being precipitated in the presence of the flax pulp fiber as an amorphous gel. Cigarettes made following the teachings of U.S. Pat. No. 4,450,847 consistently provide a nominal 50% reduction in sidestream particulate smoke delivery rate which is approximately 1.0 mg/minute total particulate matter, as compared to $2.1 \pm 0.1$ mg/minute from conventional commercial cigarettes.

Since the in situ precipitated magnesium hydroxide filler, in combination with the alkali metal acetate burning chemical, is responsible for the unique sidestream smoke reduction characteristics of cigarettes made by the process of U.S. Pat. No. 4,450,847, it seemed possible that additional sidestream smoke reduction could be achieved by simply increasing the level of in situ precipitated magnesium hydroxide filler. Unfortunately, increasing the precipitated magnesium hydroxide filler level to greater than 15% caused cigarettes wrapped in these high magnesium hydroxide filler level sheets to self-extinguish and eventually become non-combustible at very high magnesium hydroxide levels. Thus, the obvious approach to increased sidestream smoke reduction was not a viable solution.

This invention constitutes a novel means of increasing the magnesium hydroxide filler level, thereby further reducing sidestream particulate smoke without causing self-extinction or non-combustibility. This is accomplished by replacing the 15% in situ precipitated magnesium hydroxide with 15% externally, but freshly, precipitated magnesium hydroxide and adding from 5% to 25% particulate magnesium hydroxide as a co-filler. Calcium carbonate may also be used as an additional co-filler at a level of 0% to 20% to further control the static burning rate of the paper. The most unexpected and novel feature of this invention is the relatively large particle size of the particulate magnesium hydroxide required to provide the maximum sidestream smoke reduction; a median particle size of 15 micrometers is optimum. The preferred wrapper embodying the above filler system is a 100% flax pulp sheet weighing 45 g/M$^2$, containing a total filler level of 40% by weight and 4% to 5% by weight of mixed sodium and potassium acetate burning chemicals.

Satisfactory results are obtained with particle size of the particulate magnesium hydroxide in the range of 2 to 50 micrometers. Since the freshly precipitated magnesium hydroxide filler is prepared externally to the pulp fibers and subsequently combined, the individual flax pulp fibers will not be as intimately coated with the magnesium hydroxide crystallites as those resulting from the in situ precipitation process, hence exerting less adverse influence on the intrinsic combustibility of the cellulosic fibers. The added particulate magnesium hydroxide co-filler with its relatively large size, small surface area, and less reactive surface should have little, if any, coating effect on the flax pulp fibers, thereby serving to merely increase the total magnesium hydroxide filler loading of the sheet. This latter factor would function to retard static burning rate and, consequently, sidestream particulate delivery rate, via the "heat sink effect" attributed to magnesium hydroxide filler.

EXAMPLE 1

The initial handsheet screening study of particulate magnesium hydroxide co-filler was designed as a two-level, three-variable, $2^3$ full-factorial experiment. Variables investigated were precipitated magnesium hydroxide filler level, particulate magnesium hydroxide filler level and particle size of the particulate magnesium hydroxide. The results are shown below:

| Handsheet Designation* | % PPT $Mg(OH)_2$ Filler | % Particulate $Mg(OH)_2$ Filler | (μm) Particle Size of Particulate $Mg(OH)_2$ | SS TPM Delivery Rate (mg/min)** |
|---|---|---|---|---|
| 1B | 5 | 5 | 2 | 1.42 |
| 2B | 10 | 5 | 2 | 0.98 |
| 3B | 5 | 10 | 2 | 1.26 |
| 4B | 10 | 10 | 2 | 0.98 |
| 5B | 5 | 5 | 15 | 1.36 |
| 6B | 10 | 5 | 15 | 0.82 |
| 7B | 5 | 10 | 15 | 1.25 |
| 8B | 10 | 10 | 15 | 0.86 |

*Handsheet Specifications: 45 g/M$^2$ basis weight, 40% total filler, $CaCO_3$ co-filler, 100% flax fiber, 206 ml SR freeness, treated with 4% KOAc burning chemical solution.

**Sidestream smoke total particulate matter.

Statistical analysis of the above data is reported below as the effect of increasing the designated variable from their low to high values on sidestream particulate delivery rate. Effects 1, 2, and 3 are primary effects; effects 12, 13, and 23 are two-factor interactions; and effect 123 is the three factor interaction. Designated variable No. 1 is % precipitated magnesium hydroxide filler, variable No. 2 is % particulate magnesium hydroxide filler, and variable No. 3 is particle size of the particulate magnesium hydroxide. The sidestream TPM effects are reported in both actual units and percent relative to average value of effect.

| Effect | Sidestream TPM Delivery Rate Effects | | | | | | |
|---|---|---|---|---|---|---|---|
| Units | 1 | 2 | 3 | 12 | 13 | 23 | 123 |
| Mg/Min | −0.41 | −0.06 | −0.09 | +0.08 | −0.05 | — | — |
| % | −36.6 | −5.4 | −8.0 | +7.1 | −4.5 | — | — |

The above analysis reveals that increasing all three primary variables reduces the sidestream particulate delivery rate. The decrease in sidestream delivery rate caused by increasing the particle size of the particulate magnesium hydroxide filler is completely unexpected.

EXAMPLE 2

The precipitated magnesium hydroxide filler level was held at 15% for the optimization handsheet study, since 15% is the maximum level now considered possible without causing self-extinction or non-combustibility of cigarettes with this type wrapper. The freshly precipitated magnesium hydroxide filler was precipitated in the presence of the particulate magnesium hydroxide, but in the absence of the flax pulp fibers. Total filler level was held constant at 40%. Calcium carbonate was employed as an additional co-filler whenever required to attain the 40% total filler level. Sidestream particulate delivery rate results are presented below.

| Handsheet Designation* | % Particulate $Mg(OH)_2$ Filler | Particle Size (μm) Particulate $Mg(OH)_2$ Filler | % $CaCO_3$ Filler | SS TPM Delivery Rate (mg/min) |
|---|---|---|---|---|
| 1B | 10 | 2 | 15 | 0.98 |
| 2B | 15 | 2 | 10 | 0.94 |
| 3B | 20 | 2 | 5 | 0.87 |
| 4B | 25 | 2 | 0 | 0.85 |
| 5B | 10 | 15 | 15 | 0.80 |
| 6B | 15 | 15 | 10 | 0.75 |
| 7B | 20 | 15 | 5 | 0.69 |
| 8B | 25 | 15 | 0 | 0.54 |

*Handsheet Specifications: 45 g/M$^2$ basis weight, 100% flax fiber, 211 ml SR freeness, 15% precipitated $Mg(OH)_2$ filler, 40% total filler, treated with 4% KOAc burning chemical solution.

This data unequivocally demonstrates the efficacy of the dual particulate/precipated magnesium hydroxide filler system in reducing sidestream particulate smoke with sidestream particulate delivery rates approaching 75% (relative to the average sidestream particulate delivery rate for conventional cigarettes of 2.1±0.1 mg/min). At this level of reduction, sidestream smoke is barely visible when the cigarette is statically burning. The handsheets with the large particle size (15 micrometer) particulate magnesium hydroxide filler provide extraordinarily low sidestream smoke deliveries. As mentioned previously, this effect would not be expected by "one skilled in the art".

EXAMPLE 3

Since a chemical adjuvant, commonly referred to as a burning chemical, is an essential ingredient of low sidestream cigarette papers based on the magnesium hydroxide/oxide filler system in its various permutations, machine-made low sidestream cigarette paper with dual particulate/precipitated magnesium hydroxide fillers was treated with various levels of potassium acetate and sodium acetate burning chemicals and evaluated for sidestream smoke characteristics. Machine-made low sidestream cigarette paper from Trial RD 99682-A2 run with water on the size press was used for this evaluation. It is a 45 g/M$^2$ basis weight sheet containing 15% precipitated magnesium hydroxide, 25% particulate magnesium hydroxide (15 micrometers median particle size), and residual $CaCO_3$ filler; it exhibited an average porosity of 24 CORESTA. Although RD 99682-A2 paper was produced with water on the size press, it still contained about 1.5% to 2.0% by weight of sodium acetate burning chemical which came from the off-line magnesium hydroxide precipitation reaction between magnesium acetate and sodium hydroxide.

Paper from trial run RD 99682-A2 was treated with aqueous solutions of 0%, 4%, 6%, 8%, and 10% by weight of sodium acetate burning chemical and 0%, 4%, 6%, 8%, and 10% by weight of potassium acetate burning chemical on a 4"-wide, laboratory size press. Cigarettes were prepared from these papers and smoked. Sidestream particulate delivery rates under dynamic puffing conditions are reported below.

| Burning Chemical | % Burning Chemical In Solution | Puff Count | Sidestream TPM Delivery Rate (mg/min) |
|---|---|---|---|
| None | 0 | — | Non-Combustible |
| KOAc | 4 | 10.51 | 0.59 |
| KOAc | 6 | 9.94 | 0.56 |
| KOAc | 8 | 10.71 | 0.55 |
| KOAc | 10 | 9.57 | 0.69 |
| NaOAc | 4 | — | Non-Combustible |
| NaOAc | 6 | 12.27 | 0.54 |
| NaOAc | 8 | 11.03 | 0.51 |
| NaOAc | 10 | 9.98 | 0.60 |

The above data reveals that treatment with 6% to 8% sodium or potassium acetate burning chemicals provide the optimum sidestream particulate delivery rate reductions. Treatment with sodium acetate tends to yield a higher puff count or slower static burning rate and potassium acetate treatment provides a more solid, whiter ash.

EXAMPLE 4

A handsheet study was conducted to determine the effect of magnesium hydroxide filler type and level on sidestream smoke generation and yield. The test experiment was expressly designed to determine whether the precipitated magnesium hydroxide filler, the particulate magnesium hydroxide filler, or a combination of both magnesium hydroxide fillers were the predominant contributor to sidestream smoke reduction. The level of precipitated magnesium hydroxide filler was held constant at 15%, since this level is known to be optimum for maximum sidestream smoke reduction (approximately 50% or 1.0±0.1 mg/min). The data are presented below.

| Handsheet Designation* | % PPT $Mg(OH)_2$ | % Particulate $Mg(OH)_2$ | % Total $Mg(OH)_2$ Filler | Sidestream TPM Delivery Rate (mg/min) |
|---|---|---|---|---|
| 1B | 0 | 40 | 40 | 1.11 |
| 1B | 0 | 50 | 50 | 1.15 |
| 1B | 0 | 60 | 60 | 1.04 |
| 2B | 15 | 25 | 40 | 0.43 |
| 3B | 15 | 35 | 50 | 0.67 |

-continued

| Handsheet Designation* | % PPT $Mg(OH)_2$ | % Particulate $Mg(OH)_2$ | % Total $Mg(OH)_2$ Filler | Sidestream TPM Delivery Rate (mg/min) |
|---|---|---|---|---|
| 4B | 15 | 45 | 60 | 0.82 |

*Handsheet Specification: 45 g/M$^2$ basis weight, 100% flax fiber, 15 micrometer particulate $Mg(OH)_2$ median particle size, treated with a 7% solution of potassium acetate burning chemical.

This data reveals that: (1) particulate magnesium hydroxide filler does, indeed, contribute by itself to sidestream reduction, although not quite as effectively as precipitated magnesium hydroxide; (2) sidestream reduction is relatively independent of magnesium hydroxide filler level over the extended range of 40% to 60% for all particulate magnesium hydroxide filler handsheets; (3) the extraordinary reduction in sidestream particulate delivery rate appears to be associated with a synergistic effect of the combined magnesium hydroxide fillers; and (4) increasing the total fillers level of the combined particulate/precipitated magnesium hydroxide fillers increases sidestream delivery rate, confirming previous studies which optimized the filler blend at 15% precipitated/25% particulate magnesium hydroxide.

SUMMARY OF THE INVENTION

Extraordinary and unexpected reductions in sidestream particulate delivery rate and yield are achieved by a low sidestream cigarette paper characterized as:

1. Containing cellulosic pulp fibers such as those provided by flax pulp or chemical wood pulp for use in conventional cigarette papers.
2. Having a basis weight between 30 g/M$^2$ and 100 g/M$^2$.
3. Containing freshly precipitated magnesium hydroxide filler, particulate magnesium hydroxide filler and calcium carbonate filler.
4. Containing freshly precipitated magnesium hydroxide filler precipitated in the presence of the particulate magnesium hydroxide filler and in the absence of the cellulosic pulp fibers at a filler level of 2% to 40% by weight in the sheet with 12% to 18% preferred.
5. Containing particulate magnesium hydroxide filler at a filler level of 5% to 60% with 15% to 25% preferred.
6. Containing particulate magnesium hydroxide filler having particle sizes of less than 2 micrometers to 50 micrometers in diameter with a median particle size of 10 to 15 micrometers preferred.
7. Containing calcium carbonate filler at a filler level of 0% to 20% with 0% to 10% preferred.
8. Containing the chemical adjuvants, or burning chemicals, potassium acetate and sodium acetate separately or in mixtures thereof at levels of 2% to 6% by weight in the sheet with 4% to 5% preferred.

Low sidestream cigarette papers embodying the features described above provide sidestream particulate delivery rates approaching 0.50 mg/min or 75% reduction relative to conventional cigarettes when employed in the fabrication of cigarettes and subsequently smoked. A statically burning cigarette which demonstrates a 70% or greater reduction in sidestream particulate smoke is perceived by an observer as having little, if any, visible sidestream smoke emanating from the burning zone.

What is claimed is:

1. A wrapper for smoking articles such as cigarettes, cigars and the like comprising a cellulosic fiber sheet containing, as filler, freshly precipitated magnesium hydroxide and particulate magnesium hydroxide applied to the fibers of the sheet.

2. The wrapper as defined in claim 1 wherein the precipitated magnesium hydroxide filler level is from 2% to 40% by weight in the sheet.

3. The wrapper as defined in claim 1 wherein the precipitated magnesium hydroxide filler level is from 12% to 18%.

4. The wrapper as defined in claim 1 wherein the freshly precipitated magnesium hydroxide filler is precipitated in the presence of the particulate magnesium hydroxide filler and in the absence of the cellulosic fibers.

5. The wrapper as defined in claim 1 wherein the particulate magnesium hydroxide filler is at a filler level of 5% to 60%.

6. The wrapper as defined in claim 1 wherein the particulate magnesium hydroxide filler is at a filler level of 15% to 25%.

7. The wrapper as defined in claim 1 wherein the particulate magnesium hydroxide filler has particle sizes of less than 2 micrometers to 50 micrometers in diameter.

8. The wrapper as defined in claim 1 wherein the particulate magnesium hydroxide filler has particle sizes of 10 to 15 micrometers in diameter.

9. The wrapper as defined in claim 1 further containing calcium carbonate co-filler at a filler level of 0% to 20%.

10. The wrapper as defined in claim 9 further containing potassium acetate/sodium acetate at levels of 2% to 6% by weight in the wrapper.

11. The wrapper as defined in claim 9 further containing potassium acetate/sodium acetate at levels of 4% to 5% by weight in the wrapper.

12. The wrapper as defined in claim 1 further containing calcium carbonate co-filler at a filler level of 0% to 10%.

13. A smoking article comprising a tobacco charge and a wrapper for the tobacco charge, said wrapper comprising a cellulosic fiber sheet containing, as filler, freshly precipitated magnesium hydroxide and particulate magnesium hydroxide applied to the fibers of the sheet.

14. The smoking article as defined in claim 13 wherein the precipitated magnesium hydroxide filler level is from 2% to 40% by weight in the sheet.

15. The smoking article as defined in claim 13 wherein the precipitated magnesium hydroxide filler level is from 12% to 18%.

16. The smoking article as defined in claim 13 wherein the freshly precipitated magnesium hydroxide filler is precipitated in the presence of the particulate magnesium hydroxide filler and in the absence of the cellulosic fibers.

17. The smoking article as defined in claim 13 wherein the particulate magnesium hydroxide filler is at a filler level of 5% to 60%.

18. The smoking article as defined in claim 13 wherein the particulate magnesium hydroxide filler is at a filler level of 15% to 25%.

19. The smoking article as defined in claim 13 wherein the particulate magnesium hydroxide filler has particle sizes of less than 2 micrometers to 50 micrometers in diameter.

20. The smoking article as defined in claim 13 wherein the particulate magnesium hydroxide filler has particle sizes of 10 to 15 micrometers in diameter.

21. The smoking article as defined in claim 13 further containing calcium carbonate co-filler at a filler level of 0% to 20%.

22. The smoking article as defined in claim 21 further containing potassium acetate/sodium acetate at levels of 4% to 5% by weight in the wrapper.

23. The smoking article as defined in claim 13 further containing calcium carbonate co-filler at a filler level of 0% to 10%.

24. The smoking article as defined in claim 21 further containing potassium acetate/sodium acetate at levels of 2% to 6% by weight in the wrapper.

25. A method for reducing the visible sidestream smoke emanated from a smoking article comprising wrapping the tobacco charge in the smoking article in a combustible cellulosic fiber sheet containing, as a filler, a freshly precipitated magnesium hydroxide and particulate magnesium hydroxide applied to the fibers of the sheet.

26. The method as defined in claim 25 wherein the precipitated magnesium hydroxide filler level is from 2% to 40% by weight in the sheet.

27. The method as defined in claim 25 wherein the precipitated magnesium hydroxide filler level is from 12% to 18%.

28. The method as defined in claim 25 wherein the particulate magnesium hydroxide filler is at a filler level of 5% to 60%.

29. The method as defined in claim 25 wherein the particulate magnesium hydroxide filler is at a filler level of 15% to 25%.

30. The method as defined in claim 25 wherein the particulate magnesium hydroxide filler has particle sizes of less than 2 micrometers to 50 micrometers in diameter.

31. The method as defined in claim 25 wherein the particulate magnesium hydroxide filler has particle sizes of 10 to 15 micrometers in diameter.

32. The method as defined in claim 25 further containing calcium carbonate co-filler at a level of 0% to 20%.

33. The method as defined in claim 31 further containing potassium acetate/sodium acetate at levels of 2% to 6% by weight in the wrapper.

34. The method as defined in claim 32 further containing potassium acetate/sodium acetate at levels of 4% to 5% by weight in the wrapper.

35. The method as defined in claim 25 further containing calcium carbonate co-filler at a filler level of 0% to 10%.

36. A method for reducing the visible sidestream smoke emanated from a smoking article comprising wrapping the tobacco charge in the smoking article in a combustible cellulosic fiber sheet containing, as a filler, a freshly precipitated magnesium hydroxide and particulate magnesium hydroxide applied to the fibers of the sheet; where the freshly precipitated magnesium hydroxide filler is precipitated in the presence of the particulate magnesium hydroxide filler and in the absence of the cellulosic fibers.

* * * * *